United States Patent [19]

LaBelle

[11] Patent Number: 4,852,203

[45] Date of Patent: Aug. 1, 1989

[54] PAINT EDGER FOR THE APPLICATION OF PAINT

[76] Inventor: Charles E. LaBelle, Rt. 2 Box 592, Oostburg, Wis. 53070

[21] Appl. No.: 165,921

[22] Filed: Mar. 9, 1988

[51] Int. Cl.[4] ..... A47L 13/00; A47L 13/06

[52] U.S. Cl. ..... 15/210 R; 15/244.1

[58] Field of Search ..... 15/210 R, 209 R, 166, 15/244.1–244.4

[56] References Cited

U.S. PATENT DOCUMENTS 3,771,190 11/1973 Tischler et al. ..... 15/244.1
4,729,143 3/1988 Dawson ..... 15/210 R

FOREIGN PATENT DOCUMENTS 588758 12/1959 Canada ..... 15/210 R
327653 3/1958 Switzerland ..... 15/244 R
1322322 7/1973 United Kingdom ..... 15/210 R

*Primary Examiner*—Peter Feldman
*Attorney, Agent, or Firm*—Andrus, Sceales, Starke & Sawall

[57] ABSTRACT

This improved invention is to provide the user with an easy improved method of edging paint on walls or surfaces usually adjacent to ceilings or other walls or surfaces, with the important provision of being able to paint into the corner of another wall and ceiling. Presently available paint applicators cannot do this. Another provision made is to easily assemble, and replace (with an inexpensive jig or fixture that is part of this invention) and discard used paint pads used with the edger.

3 Claims, 2 Drawing Sheets

PAINT EDGER FOR THE APPLICATION OF PAINT

BACKGROUND OF INVENTION

This invention is related to paint applicators, or like apparatus and in particular to edging paint on walls adjacent to ceilings or other surfaces similar to U.S. Pat. No. 2,810,148 Paint Applicator. When interior walls are to be painted, especially with a paint roller, it becomes necessary to "cut in" or edge the wall to be painted to complete the painting task. A paint roller is incapable of doing this job and cutting in with a paint brush takes an inordinate amount of painting skill. In U.S. Pat. No. 2,810,148 this edger provides a sharp paint edge in conjunction with the adjacent wall or ceiling. However good as this edger is, it cannot paint into corners of adjacent walls. This applicator has an expensive replaceable paint pad. This pad is fixed to the applicator by the action of friction of rolled edges on the pad. This arrangement does not preclude slipping, especially when painting and approaching the ceiling for instance. My invention has an adhesive backed foam paint pad that is firmly attached to the edger body. I have 1 provided an inexpensive cardboard loading fixture that aligns the paint pad to the edger with accurate registration.

SUMMARY OF THE INVENTION

It is the general object to this invention to provide an improved paint edger that will make a sharp paint strip and will paint into corners.

Another object of this invention is to provide a simple method of attaching the foam paint pad to the edger.

Yet another object of the invention is to provide a paint edger that is simply constructed and therefore low cost.

Yet another object to the invention is to provide a simple and easy way to replace or remove used paint pads.

Still another object is to provide a means to replace an inexpensive foam paint pads to eliminate tedious clean up of the edger.

BRIEF DESCRIPTION OF THE DRAWINGS

The function, objects and other advantages will become apparent from the following description and accompanying drawings in which.

DETAILED DESCRIPTION OF THE PREFERRED EMBODIMENTS

Figure 1:
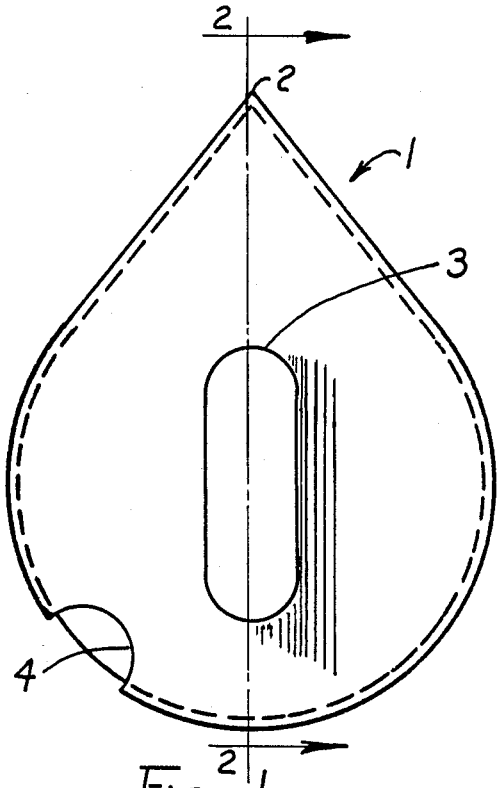
FIG. 1 is an elevation of the rear of the paint edger of my invention and the preferred embodiment of my invention.
Figure 2:
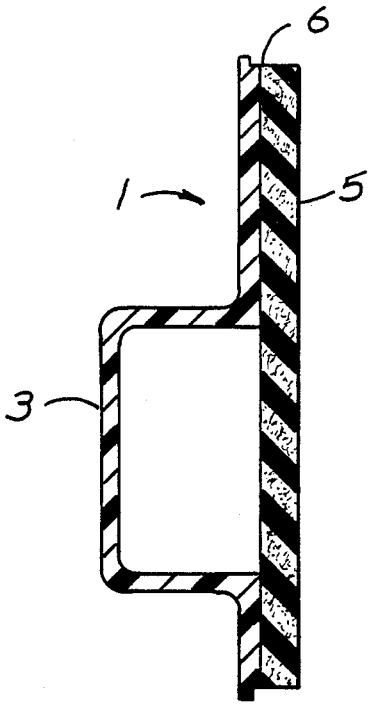
FIG. 2 is a vertical section view of the left side and taken on line 2—2 on FIG. 1.
Figure 3:
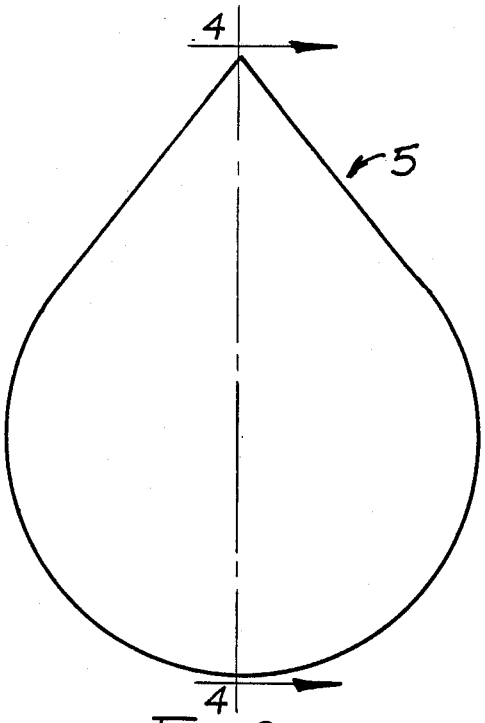
FIG. 3 is an elevation view of the disposable paint applicator pad which forms a part of my invention.
Figure 4:
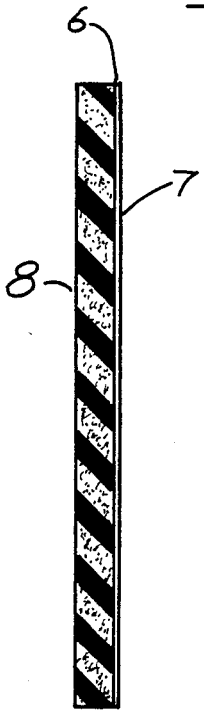
FIG. 4 is a vertical section view thereof of the left side and taken on a line 4—4 on FIG. 3.
Figure 5:
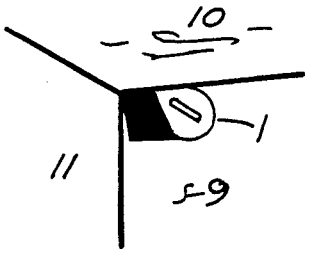
FIG. 5 is view of the invention applying paint on a wall and in a corner and showing the adjacent wall and ceiling.
Figure 6:
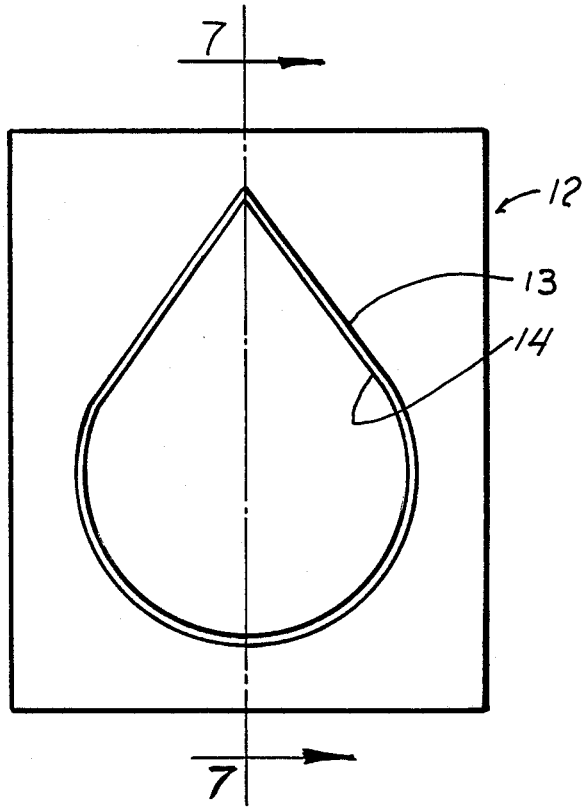
FIG. 6 is an elevation view of the cardboard pad loading jig or fixture which is part of my invention.
Figure 7:
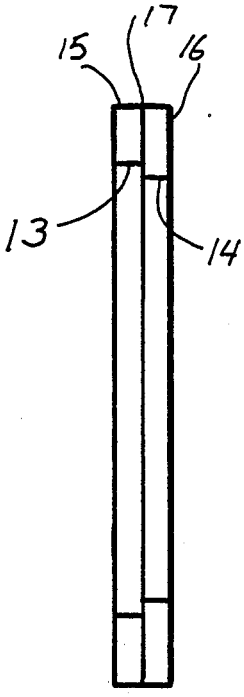
FIG. 7 is a vertical section view of the left side taken on a line 7—7 on FIG. 6.

My invention, a paint edger, consists of two parts—the edger 1 and the paint pad 5. The edger 1 is a molded part of a plastic material that is resistant to the usual paint solvents. The edger 1, of any shape with a pointed end, has a pointed end 2 and is provided with a handle 3. A cutout 4 is provided to allow easy removal of the paint pad 5. In FIG. 2 the paint pad 5 is attached to the edger 1 by the adhesive 6 on one side of the foam pad 5. FIG. 3 shows the paint pad 5. The paint pad is made of a reticulated plastic foam, similar shape to the edger 1, except being slightly smaller in size. Located on one side of the foam 8 is an adhesive 6 that is protected by a paper backing 7 when the paint pad is not being used. In FIG. 5 this illustration shows the edger 1 applying paint to and edging the wall 9, and also shows painting the corner formed by wall 9, wall 11, and ceiling 10. The jig or fixture 12 shown in FIG. 6 shows two matching cutouts 13 and 14. The smaller cutout 13 receives the paint pad 5, with the paper backing 7 removed, and in an adhesive face up attitude. The larger cutout 12 then receives the edger 1 which contacts the adhesive 6 and makes the assembly with accurate registration. FIG. 7 shows the construction of the jig or fixture 12 were two cardboard or similar materials, parts 15, and 16 are held together with glue 17. The relationship of the cutouts 13 and 14 are further described and shown.

I claim:

1. In combination, an assembly for accurately assembling a paint pad to a paint edger, comprising:

a paint edger having a flat, rigid body and a handle connected to and projecting from said body;

a paint pad having a flat, foam body for applying paint and an adhesive layer on one side of said foam body; and a loading fixture including a flat member having an opening formed therethrough and a shoulder formed along the periphery of said opening defining a first cutout portion dimensioned to receive said edger body and a second cutout portion dimensioned to receive said pad body so that a flat surface of said edger body engages the adhesive layer of said pad to attach said pad to said edger body.

2. The combination of claim 1 wherein said edger body includes a notch formed along its periphery to permit manual removal of said pad from said edger body.

3. The combination of claim 1 wherein said paint edger and pad are both formed with only a single pointed end.

* * * * *